US006068030A

United States Patent [19]

Tatsuno

[11] Patent Number: 6,068,030

[45] **Date of Patent: *May 30, 2000**

[54] FUELING SYSTEM

[75] Inventor: Hiyoshi Tatsuno, Tokyo, Japan

[73] Assignee: Tatsuno Corp., Tokyo, Japan

[ * ] Notice: This patent is subject to a terminal disclaimer.

[21] Appl. No.: 09/172,650

[22] Filed: Oct. 15, 1998

[51] Int. Cl.[7] ..... B65B 1/30

[52] U.S. Cl. ..... 141/94; 141/96; 141/83; 141/192; 73/24.05

[58] Field of Search ..... 141/94, 95, 96, 141/83, 192, 198, 196, 392; 73/24.05, 24.06; 222/74, 75; 364/479.12, 479.1, 479.11

[56] References Cited

U.S. PATENT DOCUMENTS

| | | | |
|---|---|---|---|
| 4,522,237 | 6/1985 | Endo et al. . | |
| 4,572,405 | 2/1986 | Miura | 222/14 |
| 4,796,678 | 1/1989 | Motohashi et al. . | |
| 5,309,957 | 5/1994 | Saisuu . | |
| 5,926,097 | 7/1999 | Kobayashi et al. | 340/616 |

FOREIGN PATENT DOCUMENTS

| | | |
|---|---|---|
| 8-169498 | 7/1996 | Japan . |
| 8-258897 | 8/1996 | Japan . |
| 10-219757 | 7/1998 | Japan . |
| 10-218294 | 8/1998 | Japan . |

*Primary Examiner*—David J. Walczak
*Attorney, Agent, or Firm*—Birch, Stewart, Kolasch & Birch, LLP

[57] ABSTRACT

A fueling system is substantially composed of one or more fueling units, a liquidation managing machine, a first fueling state communicator, and a second fueling state communicator. The units contains a fuel sort discrimination unit for supplying fuel of which sort is consistent with fuel in a tank to be fueled, and a full-tank fueling unit for filling up the tank with fuel to a full-tank level. The liquidation managing machine settles accounts and controls signals input from the fueling units. The first fueling state communicator and the second fueling state communicator indicate fueling states of the fueling units, the first fueling state communicator functions by receiving signals from the liquidation managing machine, and the second fueling state communicator functions by receiving signals from the first fueling state communicator. In the fueling system, signals from the liquidation managing machine is transmitted to the second fueling state communicator invariably through the first fueling state communicator.

3 Claims, 6 Drawing Sheets

FUELING SYSTEM

BACKGROUND OF THE INVENTION

1. Field of the Invention

The present invention relates to a fueling system for supplying fuel to automobiles, more specifically to a fueling system with which fuel sort discrimination, full-tank level fueling, and liquidation at a high speed can be performed.

2. Description of the Related Art

Japanese publication of unexamined applications 6-115598 and 8-169498 propose fueling systems with a fuel sort discrimination unit by which it is prevented to supply different kinds of fuel to automobiles from those contained in tanks of automobiles. Fueling systems with full-tank fueling units for automatically fill tanks of automobiles with fuel are disclosed in Japanese publication of unexamined applications 58-41095 and 63-125196. Moreover, a fueling system is proposed in Japanese publication of unexamined Application 8-258897, by which fueling operation can effectively be performed by a few people with the provision of fueling state communicators. Each of these is effectively employed as it is, but a fueling system with all of these functions has not yet been reported.

In the fueling system with the fuel sort discrimination unit controls not to feed a different sort of fuel from fuel in a tank of an automobile. However, additional fueling by a man have to be made for fueling to a full-tank level when the fueling system with the fuel sort discrimination unit is solely used. Moreover, the fueling system having a full-tank fueling unit automatically supplies fuel. There is, however, such a risk that a different sort of fuel from the one in a tank is accidentally supplied. Furthermore, many operators are necessary for a fueling system without a fueling state communicator.

SUMMARY OF THE INVENTION

It is therefore an object of the present invention to provide a fueling system by which a different kind of fuel from fuel in a tank of a car to be fueled is never fed, an automatic fueling can be performed to a full-tank level of a tank, fueling can effectively performed by a few people, and liquidation is speedily carried out.

The above object of the present invention can be achieved by a fueling system comprising one or more of fueling units, a liquidation managing machine, a first fueling state communicator, and a second fueling state communicator, wherein each the fueling units comprises a fuel sort discrimination unit for supplying fuel of which sort is consistent with fuel in a tank to be fueled, and a full-tank fueling unit for filling up the tank with fuel to a full-tank level, and wherein the liquidation managing machine settles accounts and controls signals input from the fueling units, the first fueling state communicator and the second fueling state communicator indicate fueling states of the fueling units, the first fueling state communicator functions by receiving signals from the liquidation managing machine, the second fueling state communicator functions by receiving signals from the first fueling state communicator wherein signals from the liquidation managing machine being transmitted to the second fueling state communicator invariably through the first fueling state communicator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The fueling system of the present invention is composed of one or more of fueling units, a liquidation managing machine, a first fueling state communicator, and a second fueling state communicator. The fueling units for use in the present invention comprises a fuel sort discrimination unit for supplying fuel of which sort is consistent with fuel in a tank to be fueled, and a full-tank fueling unit for filling up the tank with fuel to a full-tank level. Moreover, the liquidation managing machine settles accounts and controls signals input from the fueling units. The first and second fueling state communicators indicate fueling states of the above-mentioned fueling units. In the present invention, the first fueling state communicator functions by receiving signals from the liquidation managing machine, the second fueling state communicator functions by receiving signals from the first fueling state communicator. Namely, signals from the liquidation managing machine are transmitted to the second fueling state communicator invariably through the first fueling state communicator.

Other feature of this invention will become apparent in the course of the following description of exemplary embodiments, which are given for illustration of the invention and are not intended to be limiting thereof.

Figure 1:
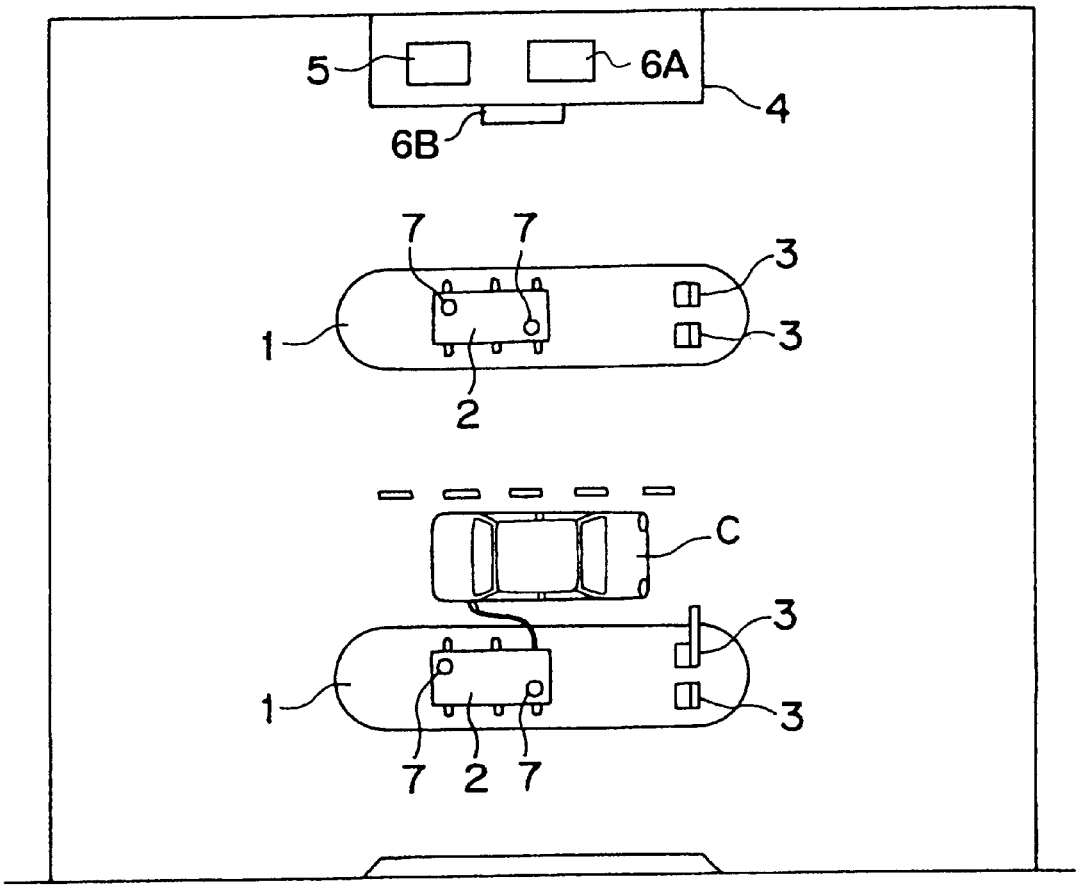
FIG. 1 is a schematic top view of a gas station as an embodiment of a fueling system according to the present invention.

FIG. 1 is a schematic top view of a gas station where a fueling system of the present invention is employed. In FIG. 1, there are provided a plurality of islands 1 in a gas station for an automobile C. A fueling unit 2 and car stoppers 3 are provided on each of the islands 1. Inside a building 4, a liquidation managing machine 5 and a first fueling state communicator 6A are placed, while a fueling state communicator 6B is provided at a place visible from each island 1 such as on an outer wall of the building 4. A rotary on-and-off light 7 is provided on each fueling unit 2.

Figure 2:
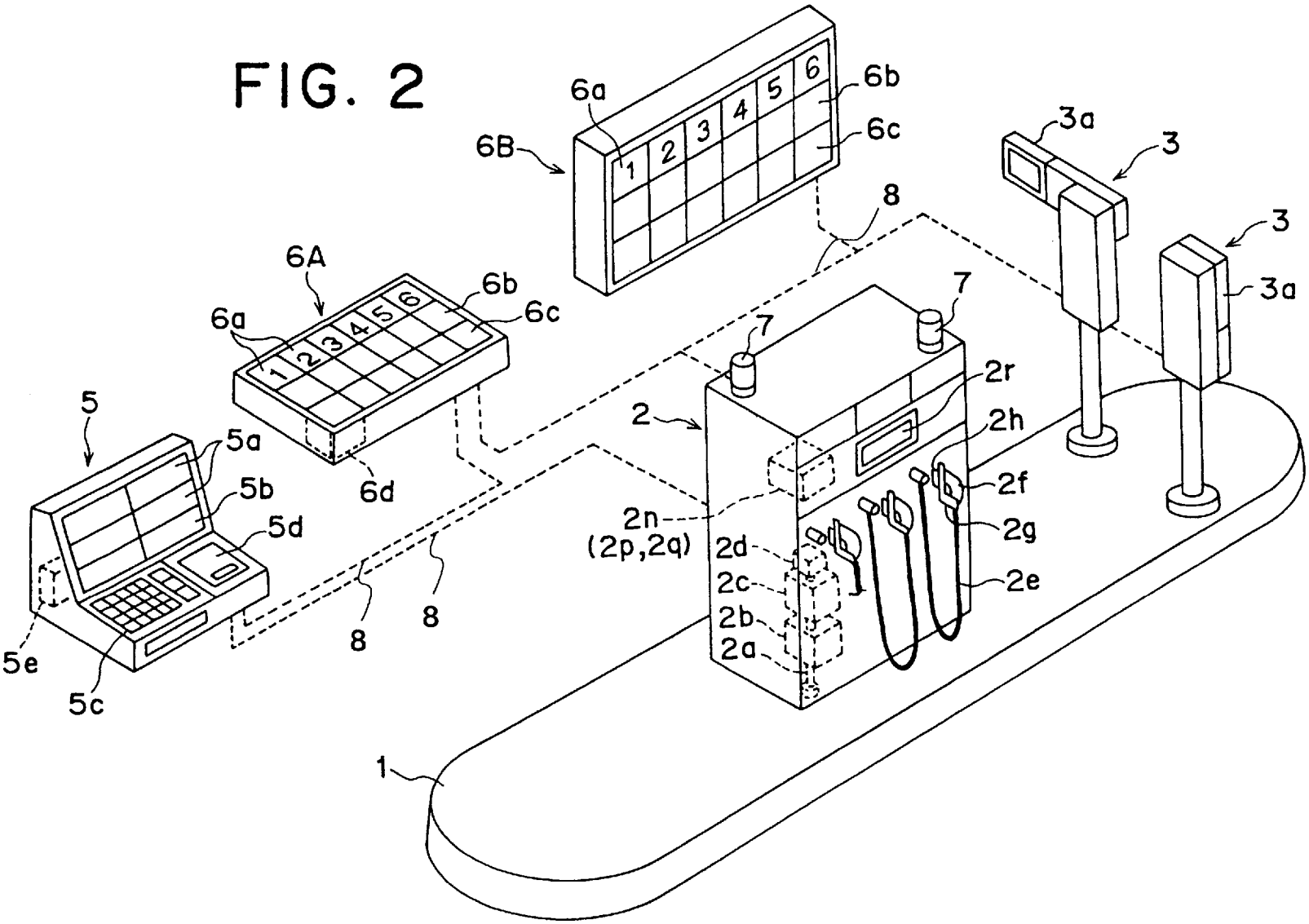
FIG. 2 is a perspective view for explaining constituents of a fueling system as an embodiment of the present invention and the relationship therebetween.

Each of the constituents of the fueling system of the present invention functions as described by the following explanation to be made by referring to FIG. 2. Reference numerals to be mentioned in FIG. 2 indicate the same constituents of the fueling system as those employed in FIG. 1. The fueling units 2, car stoppers 3, liquidation managing machine 5, first and second fueling state communicators 6A and 6B, and rotary on-and-off lights 7 are connected by signal conductors 8 to each other.

In this figure, the fueling unit 2 provided on the island 1 contains three dispenser series, each of which is for dispensing a predetermined sort of fuel such as regular gasoline, high-octane gasoline or diesel oil. A fueling pipe 2*a* for each dispenser series has a pump 2*b*, a flow meter 2*c* and a control valve 2*d* thereon, with a fueling pipe 2*a* being connected to the fueling hose 2*e* at the free end thereof. Furthermore, a fueling nozzle 2*f* is adjusted to a free end of the fueling hose 2*e*. Each nozzle rest 2*g* for accepting the fueling nozzle 2*f* has a nozzle switch 2*h* which turns on and off respectively corresponding to taking off and hanging up of the fueling nozzle 2*f*.

Figure 3:
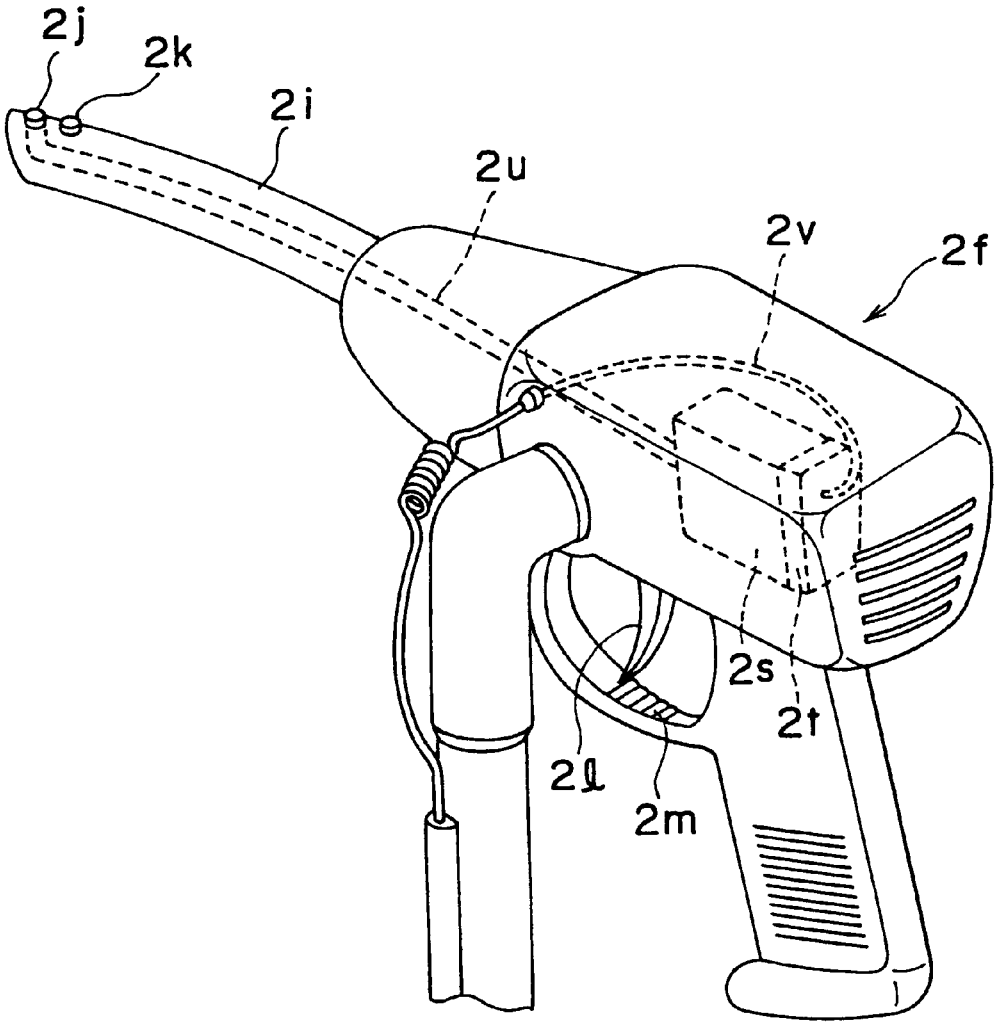
FIG. 3 is a perspective view of an embodiment of a fueling nozzle for use in a fueling system according to the present invention.

FIG. 3 is a perspective schematic view of a fueling nozzle 2*f* for use in the present invention. Vapor of fuel contained in a tank of an automobile is introduced from the vapor absorption port 2*j* to a gas sensor chamber 2*s* contained in the fueling nozzle 2*f* through a vapor leading tube 2*u* provided in a barrel portion 2*i* communicating between the vapor absorption port 2*j* and the gas sensor chamber 2*s*. The sort of the vapor state fuel is sensed by means of a gas sensor 2*t* provided at a back side of the gas sensor chamber 2*s*, and compared with a predetermined signal for representing a sort of fuel in the corresponding dispenser series, which signal is led via a wire 2*v* connected to a fueling control part 2*n* in the fueling unit 2 (FIG. 2). Only when the signal is consistent with the detected fuel sort, fueling is started. Thus, the fuel sort discrimination is performed. Further details of the fuel sort discrimination is as described, for instance, in U.S. Pat. No. 5,309,957, JP-A 6-115598 and JP-A 8-169498.

Moreover, there are provided a liquid detection hole 2*k*, which will be explained below, on the barrel portion 2*i*, and a latch 2*m* for retaining a fueling lever 21 thereon.

Referring back to FIG. 2, the fueling unit 2 has a fueling control part 2*n* wherein a fuel sort discrimination unit 2*p* and a full-tank fueling unit 2*q* are provided. The fuel sort discrimination unit 2*p* judges the consistency between the above-mentioned signal and the fuel sort actually remaining in a tank of an automobile to which fueling is going to be carried out. On the other hand, the full-tank fueling unit 2*q* has such function to suspend fueling when the liquid detection hole 2*k* is closed by bubbles or liquid at the stage where fueling to the tank is almost completed, and the fueling is started after a certain period of time again. These "fueling stop" and "fueling re-start" steps are repeatedly performed, so that full-tank fueling is performed without overflow of fuel (cf. U.S. Pat. Nos. 4,522,237 and 4,796,678, JP-A 58-41095 and JP-A 63-125196).

The fueling control part 2*n* brings the number of the previous fuel amount shown in a fuel amount indicator 2*r* to zero, outputs a fueling start signal to a liquidation managing machine 5, a first fueling state communicator 6A usually placed indoors for indicating fueling state of each of the fueling units 2 to people inside the previously mentioned building 4, and then to a second fueling state communicator 6B usually placed outdoors for indicating fueling state of each fueling units to people outside the building 4. In addition, the fueling control part 2*n* actuates the fuel sort discrimination unit 2*p*. When the fuel sort discrimination unit 2*p* confirms the identification of fuel sorts, the pump 2*b* is driven with the full-tank fueling unit 2*q* being operated.

The fueling data obtained by being calculated via the flow meter 2*c* is displayed on the fuel amount indicator 2*r*, the data is simultaneously output to the liquidation managing machine 5. The fueling control part 2*n* stops the drive of the pump 2*b* when fueling is carried out to a fu-tank level, outputting a fueling completion signal to the liquidation managing machine 5 and the first fueling state communicator 6A. In the fueling system of the present invention, signals from the liquidation managing machine 5 are transmitted to the second fueling state communicator 6B invariably through the first fueling state communicator 6A.

In the case where the fuel sort inconsistency is confirmed by the fuel sort discrimination unit 2*p*, a wrong fuel signal is transmitted from the fueling control part 2*n* to the liquidation managing machine 5 and the first and second fueling state communicators 6A and 6B.

Thereafter, the fueling nozzle 2*f* is hung on the nozzle rest 2*g*, whereby an OFF signal is input from the nozzle switch 2*h* to the fueling control part 2*n*. This time again, a fueling completion signal is output to the liquidation managing machine 5 and to a first and then to a second fueling state communicators 6A and 6B.

The car stoppers 3 placed on the islands 1 each have a stopper arm 3*a*, which indicates "possible to leave" to have the stopper arm 3*a* in a hung down position as shown by the right side car stopper 3*a* shown in FIG. 2, and "impossible to leave" to have the stopper arm 3*a* horizontally held as shown by the left-side car stopper 3*a* in the figure.

The liquidation managing machine 5, which is to be provided at a fare adjustment office in the building 4, has an indicator 5*b* with panels 5*a*, each representing a certain fueling unit 2. Furthermore, the liquidation managing machine 5 has a keyboard 5*c*, and a printer 5*d*. The liquidation managing machine 5 has a liquidation control part 5*e* inside the casing thereof. The liquidation control part 5*e* starts to manage the fueling data from the fueling units 2 when fueling start signals are input therefrom, and shows on a corresponding panel 5*a* that liquidation is to be carried out (liquidation wait) when fueling completion signals are input. In the case where the completion signal is input with keys on the keyboards 5*c* pressed, a fueling bill is issued from the printer 5*d*. The liquidation completion signal is transmitted from the liquidation control part 5*e* to the first and second fueling state communicators 6A and 6B, thereby completing the management of fueling data. On the other hand, the management of fueling data is finished, upon the receipt of a fueling completion signal after the input of a wrong fuel signal.

Each of the first and second fueling state communicators 6A and 6B has a panel on the surface thereof with fueling unit numbers 6*a*, and correspondingly fueling state lamps 6*b* and liquidation lamps 6*c* below the fueling unit numbers 6*a*. The communicator control part 6*d* provided in a casing of the first fueling state communicator 6A turns on a corresponding fueling state lamp 6*b* when receives the fueling start signals, and controls to horizontally protrude the stopper arm 3*a* of the car stopper 3. In the case where the fueling completion signal is input, the communicator control part 6*d* turns on and off a corresponding fueling state lamp 6*b* simultaneously with driving the rotary on-and-off light 7. The communicator control part 6*d* further turns off the fueling state lamp 6*b* and rotary on-and-off light 7, and turns on and off an liquidation lamp 6*c* when receives the fueling completion signal. The liquidation lamp is turned off and the stopper arm 3*a* of the car stopper 3 is hung down by receiving the liquidation completion signal.

As mentioned above, when a wrong fuel signal is received by the communicator control part 6*d*, the corresponding fueling state lamp 6*b* is turned on and off, and the rotary on-and-off light 7 comes to be driven. Here, the fueling state lamp 6*b*, the rotary on-and-off light 7 are turned off, and the stopper arms 3*a* are hung down after the input of the fueling completion signal.

The general motion of the fueling system of the present invention will now be explained specially on the fueling control part 2*n* of the fueling unit 2, liquidation control part 5*e* of the liquidation managing machine 5, and communicator control part 6*d* of the first fueling state communicator 6A referring to flow-charts shown respectively in FIGS. 4 to 6.

The car stopper 3 has a stopper arm 3*a* in a hang down state as shown in previously employed FIG. 2 as the right side-car stopper 3 when there is no car in front of the fueling unit 2. In this condition, fueling state lamps 6*b* and liquidation lamps 6*c* of the first and second fueling state communicators 6A and 6B and rotary on-and-off. light 7 provided on the fueling units 2 are all off.

A customer of the gas station stops his car C in front of a non-occupied fueling unit 2 as shown in FIG. 1. A fueling operator who has recognized the car C stopped goes up to the fueling unit 2, takes the fueling nozzle 2*f* for a desired sort of fuel off the nozzle rest 2*g*, inserts the fueling nozzle 2*f* to a fueling port of the car C, and pulls the fueling lever 21 retaining the same on the latch 2*m*.

Figure 4:
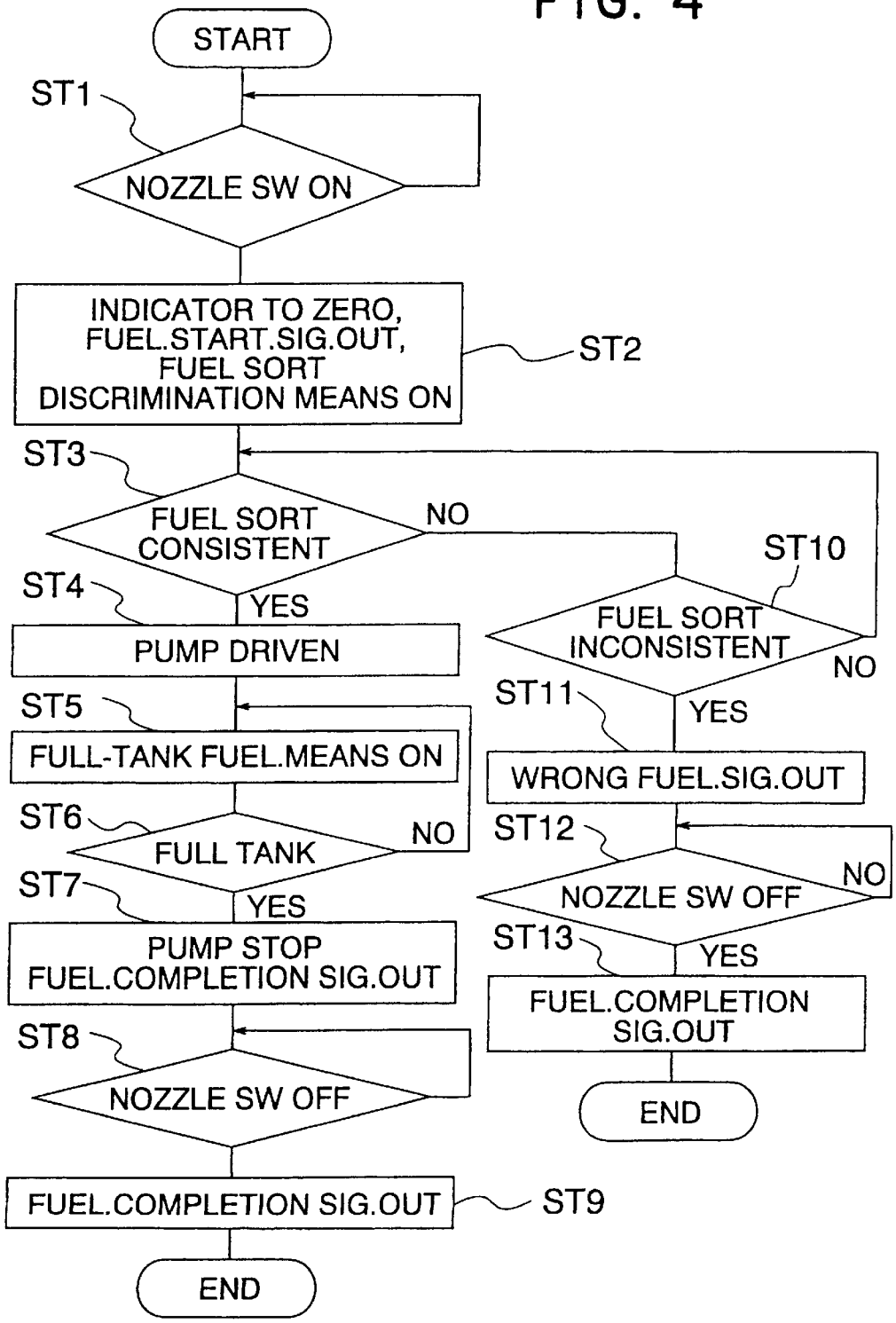
FIG. 4 is a flow-chart for explaining the operation of a control part of a fueling unit for use in a fueling system of the present invention.

When a fueling nozzle 2*f* is taken off the nozzle rest 2*g* by that an ON signal is input with the nozzle switch 2*h* closed (FIG. 4, ST1), the indicator 2*r* which shows the previously fueled amount thereon is brought to show the number zero, a fueling start signal is output to the liquidation managing machine 5 and the first fueling state communicator 6A and then to the second fueling state communicator 6B, whereby the fuel sort discrimination unit 2*p* is operated (FIG. 4, ST2). The liquidation control part 5*e* of the liquidation managing machine 5 receives the fueling start signal (FIG. 5, ST1). Thereafter, the liquidation control part 5*e* starts to manage the fueling data of the fueling unit 2 (FIG. 5, ST2).

Figure 6:
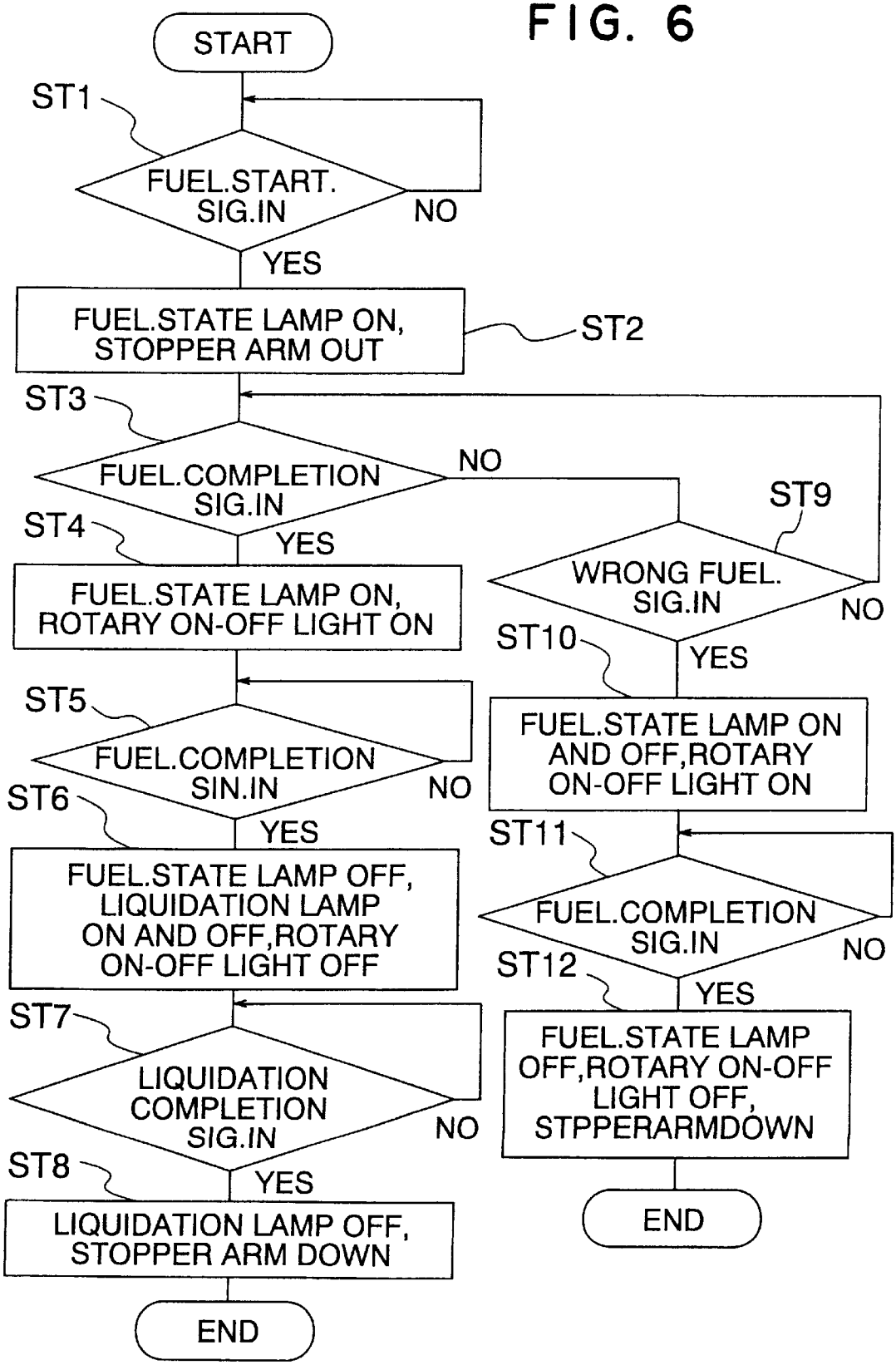
FIG. 6 is a flow-chart for explaining the operation of a control part of a first fueling state communicator for use in a fueling system of the present invention.

The communicator control part 6*d* of the fueling state communicator 6A which also has received the fueling start signal (FIG. 6, ST1) turns on the fueling state lamps 6*b* of the fueling state communicators 6A and 6B corresponding to a certain fueling unit 2 in use, and rotates the stopper arm 3*b* of the car stopper 3 into a horizontally reached state (FIG. 6, ST2).

Thus, the fueling state lamps 6*b* corresponding to the fueling unit 2 turn on indicating "while in use", as the car C is prevented from starting by the horizontally reached stopper arm 3*a*.

By functioning the fuel sort discrimination unit 2*p*, vapor in the car tank is absorbed from the vapor absorption port 2*j* of the fueling nozzle 2*f* which has been introduced into the tank, and the sort thereof is discriminated whether or not fuel in the tank of the car C is consistent with the one to be fueled. When the fuel sorts are consistent with each other (FIG. 4, ST3), fueling is started by the pump 2*b* being driven (FIG. 4, ST4). Then, the full-tank fueling unit 2*q* functions, whereby fueling is performed to a full-tank level (FIG. 4, ST5 and ST6). As previously described, fueling is suspended when bubbles on the fuel surface comes to the liquid detection hole 2*k*. Subsequently, fueling is started again after the bubbles break and the liquid detection hole 2*k* comes back to be open. This fueling process of bubble detection and bubble breakage is repeatedly performed to obtain the fuel surface at the height of the liquid detection hole 2*k* (full-tank level).

The display 2*r*, on one hand, represents the fueled amount as a number, measured by means of the flow meter 2*c* while fueling. On the other hand, the fueled amount is output to the liquidation managing machine 5.

With the completion of fueling to the full-tank level (FIG. 4, ST6), the operation of the pump 2*b* is stopped, and the fueling completion signal is output to the fueling state communicators 6A and 6B (FIG. 4, ST7). The first fueling state communicator 6A, which has received the fueling completion signal at the communicator control part 6*d* thereof (FIG. 6, ST3), turns on and off the corresponding fueling state lamps 6*b* and drives the rotary on-and-off light 7 (FIG. 6, ST4).

As explained above, the fueling operator can deal with other work after he hooked the fueling lever 21 on the latch 2*m* with the fueling nozzle 2*f* inserted to the fueling port of a car since the fueling completion is indicated by the communicators at the stage where a correct sort of fuel is filled up to the "full-tank level".

A fueling operator, who has noticed on and off of the fueling state lamps 6*b* and the drive of the rotary on-and-off light 7, goes up to the fueling unit 2 to extract the fueling nozzle 2*f* from the fueling port of the car, followed by hanging the fueling nozzle 2*f* on the nozzle rest 2*g*, whereby the nozzle switch 2*h* is turned off (FIG. 4, ST8), and the fueling completion signal is output to the liquidation managing machine 5 and the fueling state communicators 6A and 6B (FIG. 4, ST9).

Figure 5:
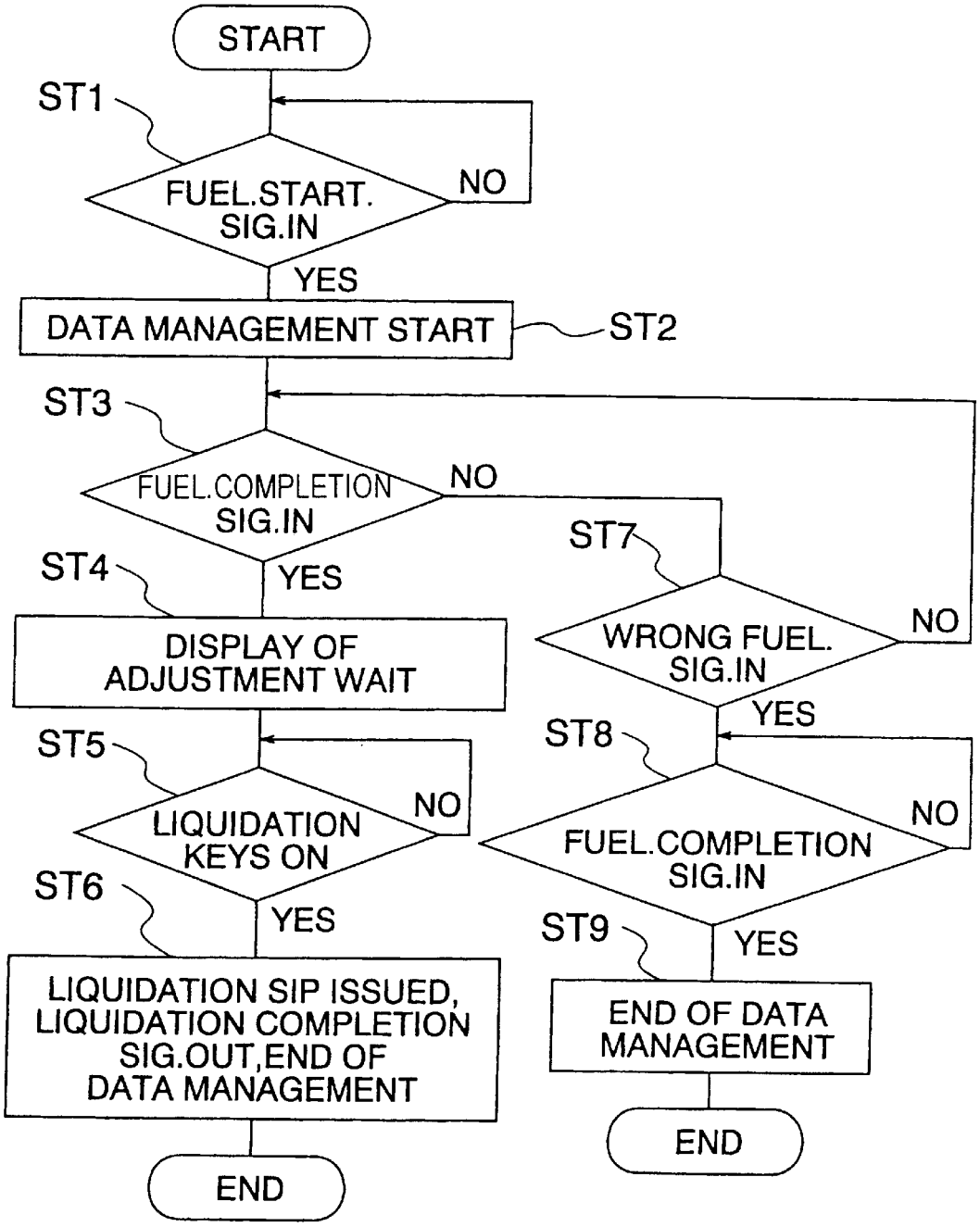
FIG. 5 is a flow-chart for explaining the operation of a control part of a liquidation managing machine for use in a fueling system of the present invention.

With the receipt of the fueling completion signal (FIG. 5, ST3), the liquidation control part 5*d* displays on a panel 5*a* thereon for a corresponding fueling unit 2 in use that liquidation is to be carried out (FIG. 5, ST4). The communicator control part 6*d* receives the fueling completion signal (FIG. 6, ST5), turns off the fueling state lamps 6*b* and the rotary on-and-off light 7 and turns on and off the liquidation lamp 6*c* (FIG. 6, ST6).

Thus, fueling is completed. The customer who has recognized the completion of fueling for his car goes to the fare adjustment office in the building 4 for settling fueling fee. Then, a clerk presses keys on the keyboard 5*c* of the liquidation managing machine 5 (FIG. 5, ST5), a fueling bill is issued from the printer 5*d*, and finally the liquidation completion signal is output to the liquidation state communicators 6A and 6B. Accordingly, the fueling data management of the fueling unit 2 is completed (FIG. 5, ST6).

The communicator control part 6*d* of the fueling state communicator 6A turns off the liquidation lamps 6*c*, rotates the stopper arm 3*a* of the car stopper 3 to be hung down (FIG. 6, ST8) when the control part 6*d* accepts the liquidation completion signal (FIG. 6, ST7).

As can be seen from the above explanation, the liquidation lamps 6*c* continue to turn on and off till the payment is completed. In addition to the above, the stopper arm 3*a* which is in the horizontally protruded state prevents cars from going without liquidating the account.

In the case where the fuel sort discrimination unit 2*p* judges that the fuel sorts in the car and in the fueling unit are inconsistent (FIG. 4, ST10), the wrong fuel signal is output from the control part 2*n* to the liquidation control machine 5 and the fueling state communicators 6A and 6B (FIG. 4, ST11). The communicator control part 6*c*, upon the receipt of the wrong fuel signal (FIG. 6, ST9), turns on and off the fueling state lamps 6*b* which correspond to the fueling unit 2 now in use, and drives the rotary on-and-off light 7 (FIG. 6, ST10).

A fueling operator, who has noticed on and off of the fueling state lamps 6*b* and the drive of the rotary on-and-off light 7, goes up to the fueling unit 2 to extract the fueling nozzle 2*f* from the fueling port, followed by hanging the fueling nozzle 2*f* on the nozzle rest 2*g*, whereby the nozzle switch 2*h* is turned off (FIG. 4, ST12), and the fueling completion signal is output to the liquidation managing machine 5 and the fueling state communicators 6A and 6B (FIG. 4, ST13), as previously described.

With the receipt of the wrong fuel signal (FIG. 5, ST7), and then the fueling completion signal (FIG. 5, ST8), the fueling data management is completed (FIG. 5, ST9). The communicator control part 6*d* receives the fueling completion signal (FIG. 6, ST11), turns off the fueling state lamps 6*b* and the rotary on-and-off light 7. The stopper arm 3*a* of the car stopper 3 is rotated to a hung down position (FIG. 6, ST12).

In this case, fueling is re-started with a fueling nozzle 2*f* for a fuel sort to be correctly supplied being taken off the nozzle rest 2*f*.

As explained above, the fueling system of the present invention automatically fills fuel which sort is consistent with one in a tank of a car to be fueled to a full-tank level. Furthermore, the fueling operation can smoothly be carried out by a few operators since the fueling completion is indicated by the communicators 6A and 6B. In addition to the above, the processing capacity of the liquidation control machine 5 can efficiently be used without the decrease of the processing speed wherein the second fueling state communicator 6B is under the control of the first fueling state communicator 6A.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fueling system comprising:

one or more fueling units;

a liquidation managing machine;

a first fueling state communicator; and a second fueling state communicator;

wherein each of said fueling units comprises a fuel sort discrimination unit for supplying fuel of which sort is consistent with fuel in a tank to be fueled, and a full-tank fueling unit for filling up the tank with fuel to a full-tank level, and wherein said liquidation managing machine settles accounts and controls signals input from said fueling units, said first fueling state communicator and said second fueling state communicator indicate fueling states of said fueling units, said first fueling state communicator functions by receiving signals from said liquidation managing machine, said second fueling state communicator functions by receiving signals from said first fueling state communicator wherein signals from said liquidation managing machine being transmitted to said second fueling state communicator invariably through said first fueling state communicator.

2. The fueling system as claimed in claim 1, wherein each of said fueling units comprises a plurality of dispenser series respectively for dispensing predetermined sorts of fuel, each of said dispenser series comprises a fueling pipe connected to a fueling hose with a fueling nozzle at the free end thereof, and a nozzle rest, for accepting said fueling nozzle, said nozzle rest having a nozzle switch for actuating said fuel discrimination unit when said nozzle is taken off said nozzle rest, said full-tank fueling unit functioning only when said fuel sort discrimination unit judges fuel sort to be dispensed is consistent with fuel in a tank, said first fueling state communicator and said second fueling state communicator starting to function at the stage where said full-tank fueling unit operates, and stopping functioning when said nozzle switch is opened with said nozzle being hung on said nozzle rest, except for a function of turning on and off a liquidation lamp which is arranged at the first and second fueling state communicators and turned off when a liquidation completion signal is output from the liquidation managing machine.

3. The fueling system as claimed in claim 2, wherein said first fueling state communicator and second fueling state communicator function when said fuel sort discrimination unit judges that the fuel to be dispensed is inconsistent with fuel in a tank, and stops functioning when said nozzle switch is opened with said nozzle hung on said nozzle rest.

* * * * *